US005546611A

United States Patent [19]

Lathrop

[11] Patent Number: 5,546,611

[45] Date of Patent: Aug. 20, 1996

[54] HIGH PERFORMANCE SWIM GOGGLE STRUCTURE

[76] Inventor: Kim N. Lathrop, 7230 SE. Market, Portland, Oreg. 97215

[21] Appl. No.: 934,022

[22] Filed: Aug. 21, 1992

[51] Int. Cl.[6] ..... A63B 33/00

[52] U.S. Cl. ..... 2/428; 2/426

[58] Field of Search ..... 2/428, 426, 429, 2/430, 446, 445, 452; 351/43, 124, 126, 128, 133, 134

[56] References Cited

U.S. PATENT DOCUMENTS

| | | | |
|---|---|---|---|
| 1,261,190 | 4/1918 | Troppman . | |
| 1,807,681 | 6/1931 | Baker . | |
| 2,007,186 | 7/1935 | Farrell . | |
| 2,393,533 | 1/1946 | Heinz . | |
| 2,709,256 | 5/1955 | Baratelli . | |
| 4,051,557 | 10/1977 | Bengtson et al. | 2/430 |
| 4,264,987 | 5/1981 | Runckel | 2/428 |
| 4,279,039 | 7/1981 | Drew | 2/428 |
| 4,286,340 | 9/1981 | Lathrop | 2/430 |
| 4,348,775 | 9/1982 | Haslbeck . | |
| 4,468,819 | 9/1984 | Ohno | 2/430 |
| 4,755,040 | 7/1988 | Haslbeck | 2/428 |
| 4,776,045 | 10/1988 | Mysliwiec et al. | 2/428 |
| 5,046,199 | 9/1991 | Hall | 2/446 |
| 5,129,109 | 7/1992 | Runckel | 2/440 |

FOREIGN PATENT DOCUMENTS

| | | | |
|---|---|---|---|
| 1431954 | 4/1976 | United Kingdom | 2/446 |
| 9000380 | 1/1990 | WIPO | 2/430 |

*Primary Examiner*—C. D. Crowder
*Assistant Examiner*—Gloria Hale
*Attorney, Agent, or Firm*—Marger, Johnson, McCollom & Stolowitz, P.C.

[57] ABSTRACT

Swim goggles wherein each eyepiece includes a lens and a wall portion for spacing the lens apart from the wearer's eye. Each eyepiece is received within an inner and outer resilient sleeve for reducing discomfort and for sealing against the wearer's face. An adjustable nose strap is connected to each eyepiece by being connected to a lug extending outwardly from the eyepiece lens.

15 Claims, 4 Drawing Sheets

HIGH PERFORMANCE SWIM GOGGLE STRUCTURE

BACKGROUND OF THE INVENTION

This invention relates to goggles for eye protection, particularly where closely conforming resilient material contacts the area surrounding the eye for the purpose of padding and/or sealing the eyepiece against the wearer's face, for activities such as swimming.

From the early part of this century designs for goggles as eye protectors have employed resilient material between the area surrounding the eye of the user, and the peripheral edge of the goggle eye piece. Early designs employed this material as cushioning for comfort, or to protect eyes from flying objects in industrial settings, or to protect from wind (e.g., Baker, U.S. Pat. No. 1,807,681 (1931).

Swimming goggles require an additional function of sealing each eyepiece against the face in a water tight manner. This is achieved by the elastic force of the head strap pulling the eyepiece against the face, and suction forces created when some air is discharged while fitting the goggles, leaving negative pressure inside the eyepiece.

It is well known in the art that these forces create pressure points and a certain amount of discomfort in exchange for a water tight fit. Greater forces equal greater discomfort, but a more secure fit against leakage.

Traditionally, the resilient material, or pad, has been defined as a gasket attached to a peripheral flange or rear frame portion of the goggle to contact the wearer's face. Lathrop, (U.S. Pat. No. 4,286,340) teaches an extension of the sealing pad to contract frame wall portions above the eye for increased comfort, while Haslbeck, (U.S. Pat. No. 4,755,040) contains a softer pad within a seal holder to prevent deformation which causes leakage. Because of the wide range in facial structure neither advancement completely addresses issues of comfortable, water tight fit. Likewise, as early as Baker, U.S. Pat. No. 1,807,681 (1931) or as late as Hall, U.S. Pat. No. 5,046,199 (1991), the cost and importance of sealing pad alignment with the correctly corresponding frame portions has been recognized.

It is also known that an adjustable and flexible nose bridge aids not only the correct alignment of lens portions in front of the eyes, but is important to seat the rearwardly facing sealing structures in a manner that will accommodate a broad range of facial characteristics.

As early as Troppman, U.S. Pat. No. 1,261,190 (1918), and as later as Hall, U.S. Pat. No. 5,046,199 (1991) ease of nose bridge assembly is a recognized factor in commercial success. However neither example is adjustable.

Flexible nose bridge straps which have projecting stops spaced longitudinally for the purpose of engaging goggle frame lugs adjacent to the nose offer adjustability of distance between eyepieces, and has been the system most used in swimming goggles since the early 1970's. Improvements to this system include Haslbeck, U.S. Pat. No. 4,348,775 (1982), and Ohno U.S. Pat. No. 4,468,819 (1984).

Runckel, U.S. Pat. No. 4,264,987 (1981) introduces a flexible strap without stops in conjunction with a mechanical adjustment system which offers unlimited spacing within a narrow range, but at greatly increased assembly and construction expense.

The art mentioned above offers shortcomings since lug structure projecting from eyepiece frame walls can come into uncomfortable contact with the side of the wearer's nose. Additionally, prior art nose straps are adjustable at both ends, creating confusion for the user.

SUMMARY OF THE INVENTION

An object of this invention is to provide an economical yet precisely made, optically clear pair of goggles which extends broadly the range of comfortable fit through user groups requiring closely conforming eye protectors.

This is achieved by employing the following combination of novel features:

The nose strap lug is moved off of the eyepiece wall or frame portions adjacent to the nasal canthus and attached to the lens or sight portion adjacent the nose. For many wearers this relieves uncomfortable contact between lug structures and the side of the nose. An additional advantage is that lug structure so attached can be elongated away from the eyes so that the nose bridge strap can span the nose without uncomfortably contacting users with more protruding noses, or relatively deeper eye sockets. As will be shown, elongation of lug structure also permits containment of the strap end after adjustments, which otherwise can be a source of discomfort for some users. Additionally, a strap pocket beginning at the lug base and closely paralleling the interior frame wall can be added to retain excess strap.

As discussed, the proper spacing of eyepieces is important in obtaining a comfortable, water tight fit in swimming goggles. Because past art offers adjustability at both ends of the nose bridge strap, the user can easily over compensate in the amount of spacing adjustment leading from one extreme of discomfort and poor fit, to another.

This invention permits the rapid, precise and permanent attachment of the nose bridge strap to one eyepiece, and improves the strap itself by adding channels formed transversely across either or both sides, and spaced to aid flexibility, particularly during adjustment.

The invention shows a new locking system on the adjustable lug using pins to secure the strap, between rigid passageway walls. The above improvements result in clear and simple means of nose bridge adjustment for the user. Because facial lineament varies widely between individuals, goggles made without the benefit of custom designing can not tightly and comfortably fit all users. The novel method for padding and sealing the eyepieces of this invention economically extends comfortable fit to many not well served by existing designs.

One known limitation to the optical clarity of goggle eyepieces made from a single process such as injection molding is that transparent frame wall portions admit light which can be reflected onto the interior of the lens portion and obstruct clear vision of things outside the eyepiece. Past art addresses this problem by forming an opaque frame and fitting a transparent lens, but at much greater cost per goggle.

This invention teaches a sealing pad at the peripheral or distal edge which extends away from the eye against the outside frame wall to cushion areas contacting the facial structure of the eye socket or nose, and may extend to the transition point between frame and lens portions of a monadically formed eyepiece to exclude light. This feature allows for the unitary construction of an eyepiece sealing pad or sleeve which cushions frame portions contacting the face, and excludes light from entering through transparent frame walls.

An additional advantage of moving the nose strap assembly to the lens portion now becomes clear. Unobstructed, smooth wall portions define an exterior eyepiece to which a pre-molded resilient sleeve can be quickly yet definitely set.

As is recognized in prior art, softer padding is initially more comfortable around the eyes than firm padding, but tends to lose its resilience, causing uncomfortable pressure points and/or leakage. The economy of this design permits the rapid yet precise overlaying of two or more pads or sleeves of different resiliencies conjoined contiguously around the goggle frame to create different layers of resilience between frame and face.

The foregoing and other objects, features and advantages of the invention will become more readily apparent from the following detailed description of a preferred embodiment of the invention which proceeds with reference to the accompanying drawings.

DETAILED DESCRIPTION OF THE PREFERRED EMBODIMENT

Figure 1:
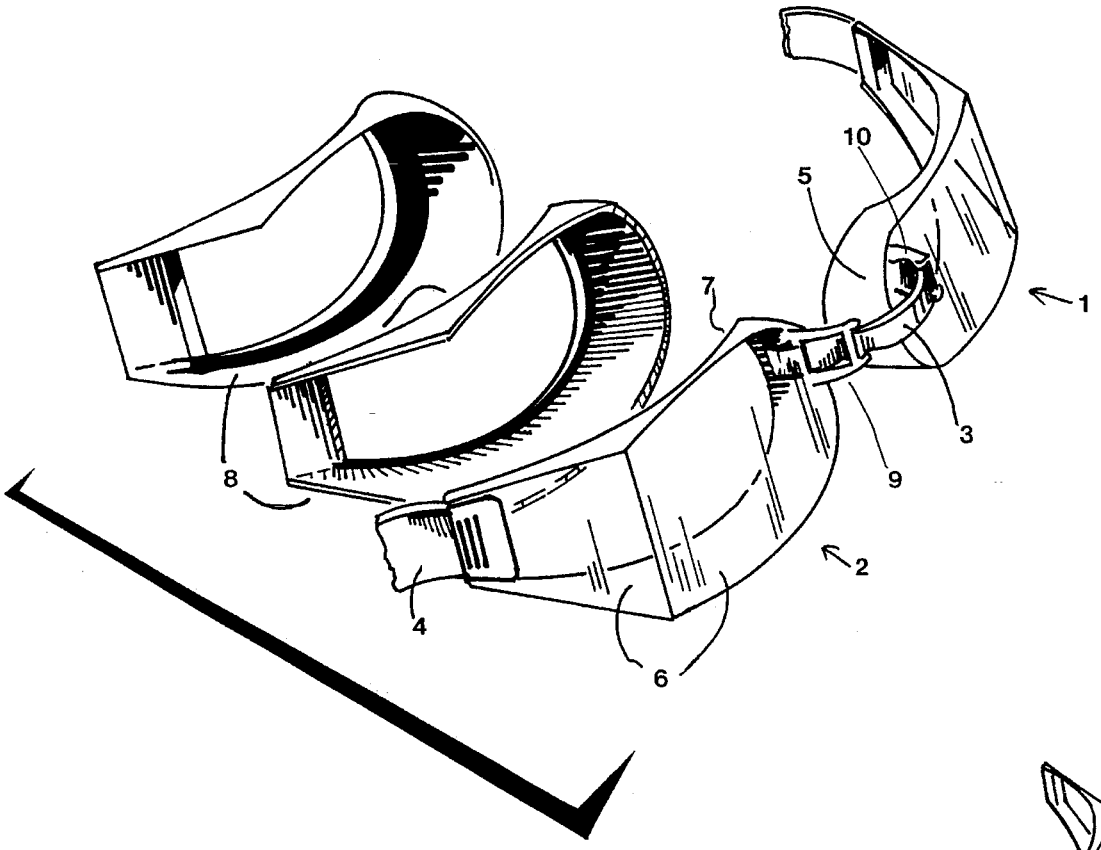
FIG. 1 of this invention shows two goggles eyepiece cups connected at their center by a nose bridge strap. A sealing pad assembly for the right eyepiece cup is shown in exploded view, showing resilient sleeves.
Figure 2:
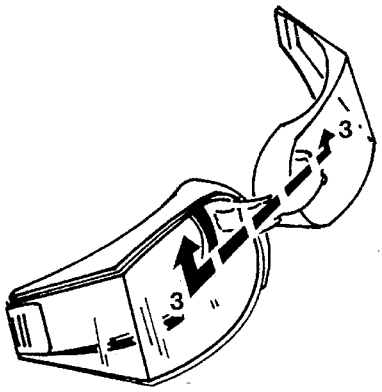
FIG. 2 shows connected eyepiece cups with the right eyepiece sealing pad assembly combined and in place.

Referring to FIG. 1, shown are a pair of goggles including a left eyepiece 1 and right eyepiece 2 which are connected at center by an adjustable, flexible nose bridge strap 3. The goggles are held in place over the wearer's eyes by an adjustable, elastic head strap 4, shown fragmented. As known in referenced prior art, the eyepieces may be formed specifically for a left or right eye, or may be formed to fit universally, and reversibly. They may be made to surround the eye socket, or be contained within the orbital brim or designed to fit partly within and outside the eye socket.

Figures 3, 4, 5:
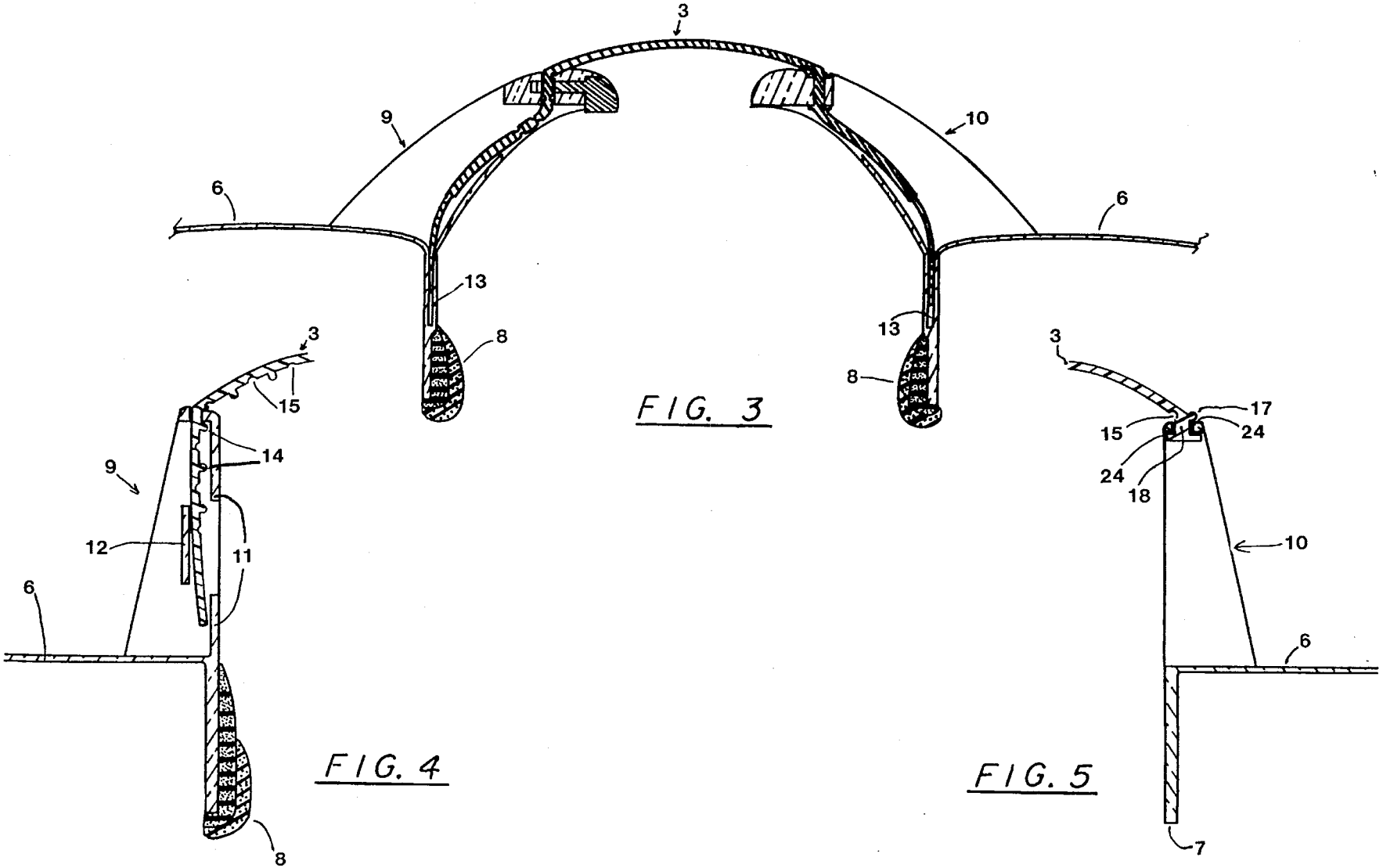
FIG. 3 shows eyepiece cup fragments sectioned on line 3—3 of FIG. 2 illustrating one embodiment of the eyepiece nose bridge lugs, adjustable nose strap and sealing pad assembly.
FIG. 4 shows a different embodiment of the nose bridge lug, fragmented nose bridge strap, and sealing pad assembly.
FIG. 5 shows a fragmented section corresponding to FIG. 4, and showing lug and nose bridge strap anchor configurations.

Each eyepiece consists of a frame wall portion 5 (also known as a frame to those skilled in the art), sight or lens portions 6, and distal frame portion 7, best illustrated sectionally in FIG. 5. Pad assembly 8 shown exploded in FIG. 1 shows two pre-molded, resilient sleeves, each having different characteristics of resiliency. One or more of these sleeves may be opaque for blocking light from entering the eyepiece through the sidewalls. The first or inner sleeve is shaped to contiguously meet the eyepiece frame beginning at the distal frame portion 7, and extend away from the eye along the exterior frame wall as shown sectionally in FIG. 3. As shown, both inner and subsequent sleeve overlays may contain an inwardly extending lip to cushion the distal frame portion 7.

In another embodiment this sleeve may extend to the point of transition between the eyepiece frame wall and the lens for the purpose of excluding light entering through a transparent frame wail, as best shown sectionally in FIG. 4. Additional resilient sleeves may be overlaid and quickly yet precisely assembled to present a pad assembly employing transitional and/or complex resiliencies between the wearer's face and the eyepiece frame.

Resilient pad overlays may be assembled in any advantageous combination of resiliencies in order to enhance comfortable sealing between the rear frame and facial structure surrounding the eyes, and cushioning for comfort between frame wall portions and contacting facial structure such as the nose and cheeks. Intermediate cushioning sleeves may be added between inner and outer sleeves to achieve this purpose. One or more of the sleeves may be more precisely molded to include an outer surface profiled to fit the facial features of an individual wearer or group of wearers.

Resilient pad overlays may be made from any of a number of materials well known in the trade. These would include, but are not limited to; natural and synthetic rubber, sponge rubber, open or closed cellular material such as polyurethane. Adhesive may be applied between the pad assembly and eyepiece frame, and between individual resilient sleeves. Individual sleeves may be pre-molded as shown in FIG. 1, made to conform from flat material, or molded in place. Pad assemblies may consist of sleeves made by any or all of the above processes.

Turning now to the nose bridge assemblies, the flexible and adjustable nose bridge strap 3 is secured to adjustable nose bridge lug 9, and anchor nose bridge lug 10. FIG. 3 shows, in section, nose bridge strap lugs 9 and 10 attached to the goggle eyepiece sight portion adjacent to the nose, elongated away from the eyes, and angled toward the nose to widen the wearer's unobstructed view. Another embodiment is shown correspondingly in FIG. 4, and FIG. 5, where the lug, beginning at the sight portion, is elongated away from the wearer's eyes along a horizontal line of sight while standing. This allows additional elongation to permit comfortable strap extension across the nose bridge of wearer's with more protruding noses, or deeper eye sockets. Also, this more angular configuration, being easier and less expensive to tool, permits the manufacture of a more economical embodiment of this invention.

After a nose bridge strap has been adjusted by the wearer to properly space the eyepieces, excess strap may be stored neatly and safely away from the eyes in elongated lug structure. This feature is shown clearly in sectional drawings FIG. 4, FIG. 6 and FIG. 8. Structural side walls cut away, but shown in outline, reveal interior strap retaining walls 11.

Wall 12 shown in FIG. 4 directs and positions excess strap away from the wearer's line of sight. Strap slots 13 shown best in FIG. 6 and FIG. 8 neatly retains excess strap, and is located between lug, structural side walls, extending into the eyepiece cup interior, parallel to the frame wall, adjacent to the nose.

Both eyepiece lugs define an aperture or passageway through which the nose bridge strap passes and is secured. These slots are shown as: 20 in FIG. 4, 21 in FIG. 5, 22 in FIG. 6, and 23 in FIG. 8.

Figure 10:
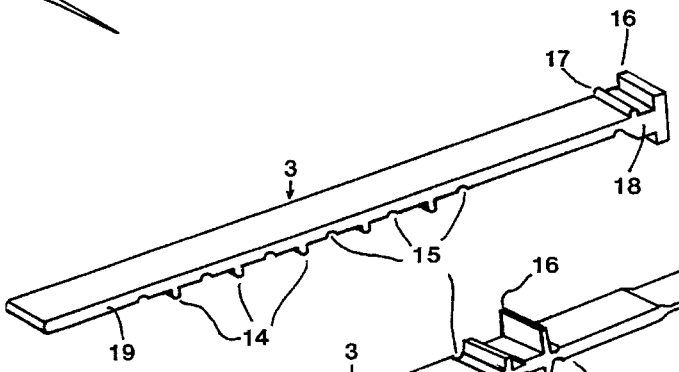
FIG. 10 illustrates a nose bridge strap shown in section in FIG. 4 and FIG. 5.

FIG. 10 shows a more conventional nose strap embodiment in that the securing means is a plurality of stops 14 projecting outwardly from its inner surface which normally prevent movement through the adjustable lug, but may be adjusted for length by a strong longitudinal pull. Channels 15 greatly aid the users dexterity in adjusting relatively small bridge strap parts by greatly increasing the flexibility of the resilient, pliable nose strap.

FIG. 10 shows anchor structure 16 and 17 which permits secure, precise and permanent assembly of the nose bridge strap to one eyepiece lug. Shown positioned in FIG. 5, the anchor end piece 16 being dimensioned large enough so that it can not pass through the lug aperture 21, but may be secured in position, for practical purposes permanently, by a very strong longitudinal pull which momentarily stretches the strap longitudinally permitting positioning stop 17 to pass through the lug aperture. When longitudinal force is released, anchor structure returns to formed dimensions, and positioning stop 17 engages outer lug surface 24.

Lug slot 21 is dimensionally as wide or wider than the sum of nose bridge strap thickness 19, and the distance of stop projection 14 from the strap inner surface. This permits the rapid, frictionless passage of stops 14 through the lug aperture 21 during assembly. Anchor block 18 is dimensioned to fit snugly between lug aperture walls, and may be made to frictionally engage said walls, holding the strap in place.

Figure 11:
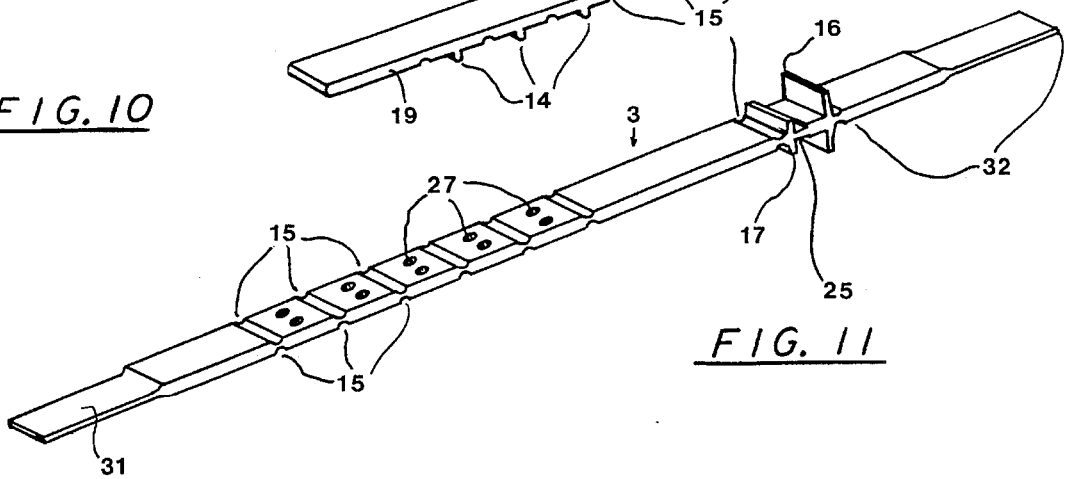
FIG. 11 illustrates a nose bridge strap shown in section in FIG. 3, FIG. 6, and FIG. 8.

FIG. 11 shows corresponding anchor structure 16, 17 in a different embodiment. As shown best in FIG. 8, positioning stops 17 are on both sides of the nose strap and bend flat into temporary containment channels 25 while passing through the lug aperture during assembly. After passing through the lug aperture, they spring back to their formed configuration, and engage outer lug surface 24, positioning anchor assembly permanently in place. The nose bridge strap FIG. 10, FIG. 11 may be made from any of a number of elastomers known in the trade which have relatively strong tensile strength, and the correct proportions of flexibility, pliability, resilience and resistance.

Figure 7:
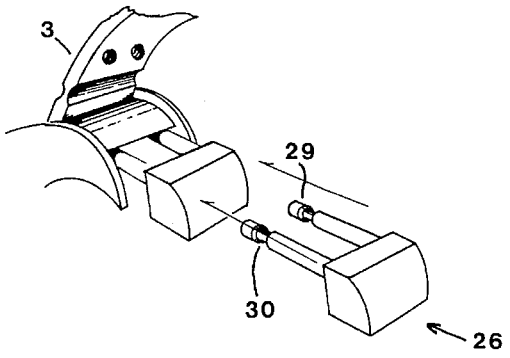
FIG. 7 demonstrates how the locking pin assembly secures the nose bridge strap shown sectionally in FIG. 6.
Figure 6:
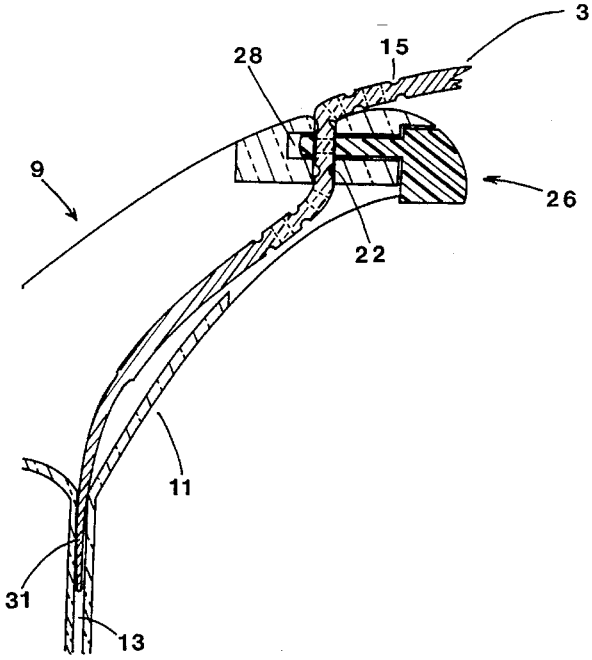
FIG. 6 and FIG. 8 show more detailed views of adjustable nose bridge strap locking lug structure and strap anchor structure.

FIG. 6 shows a positive pin locking assembly 26 that secures the adjustable end of the nose bridge strap to the adjustable nose bridge lug. Once the wearer has determined the correct eyepiece spacing, he aligns the corresponding set of longitudinally spaced strap adjustment holes, FIG. 11, 27 with the entrance of the tubal channels, FIG. 6, 28, which penetrate interior walls of the lug slot. This allows insertion of the pin locking assembly 26, penetrating with the forepart 29, FIG. 7 the smaller strap adjusting holes, and then the opposite interior lug wall.

The strap adjusting holes resiliently return to their original diameter and engage the narrowed pin shaft 30. Thus the nose bridge strap is positively locked in place as shown in FIG. 6, snugly fitting between rigid interior lug aperture walls. Pin linkage prevents longitudinal strap movement in either direction, engagement between the strap adjustment holes 27 and narrowed pin shaft 30 prevents dislodging of the pin locking assembly 26 from the tubal channels 28.

Figure 8:
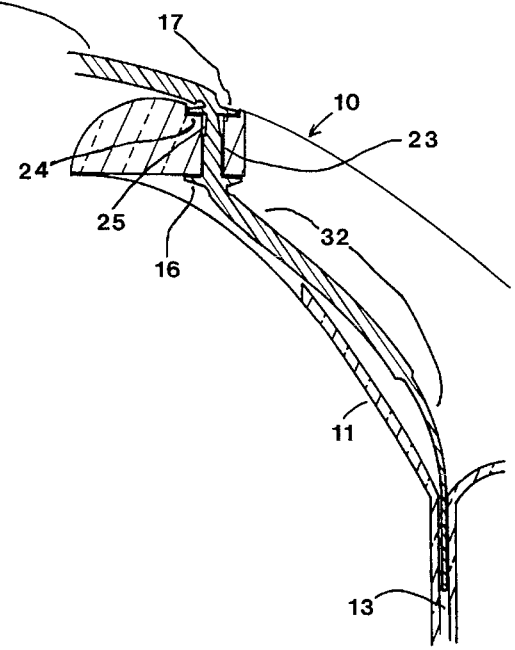
Figure 9:
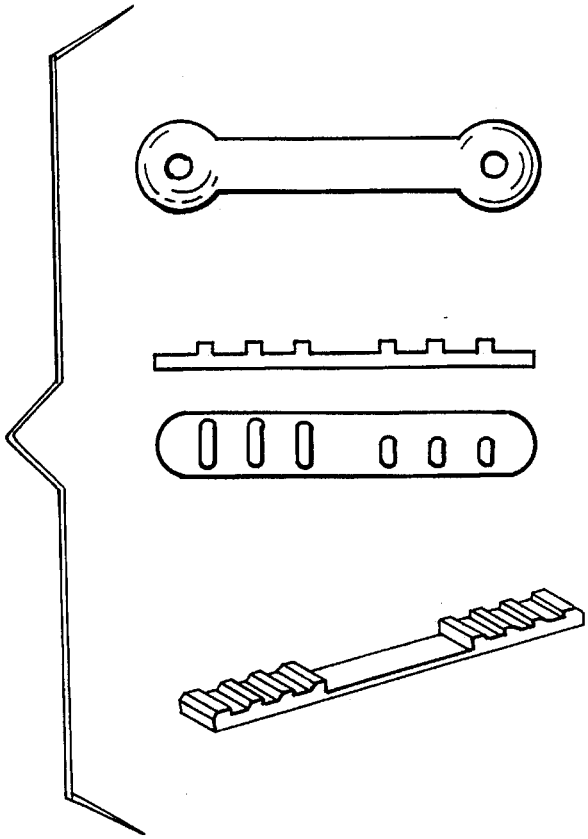
PRIOR ART FIG. 9
FIG. 9 shows prior art goggle nose bridge straps.

FIG. 11, 31 shows an optional nose strap slot tail, where strap thickness is reduced at the adjustable end, to permit corresponding slimming of the strap slots 13, FIG. 6, so that the overall thickness of slot structure remains outside the users line of sight, and towards the nose. 32 shows an optional strap tail deployed in the nose strap lug as shown in FIG. 8 for the purpose of symmetrical appearance with the adjustable strap end shown in FIG. 6, when the goggles are seen frontally on the wearer's face.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. Swim goggles comprising:

(a) a pair of eyepieces each having a lens and an eyepiece wall for spacing said lens apart from a wearer's eye, said eyepiece wall having a front edge connected to said lens, a distal rear edge, and a smooth outer surface free of protrusions;

(b) a nose strap connecting said eyepieces;

(c) a head strap connected to each eyepiece for extending around the head of a wearer;

(d) a first resilient sleeve having a first portion covering at least a portion of said eyepiece wall outer surface, and having an inwardly extending lip covering at least a portion of said eyepiece wall rear edge; and (e) a second resilient sleeve overlaying at least a portion of said first resilient sleeve.

2. Swim goggles according to claim 1 wherein said inwardly extending lip has an area larger than that of said eyepiece wall rear edge, for reducing the pressure exerted by said eyepiece wall rear edge on the wearer's face.

3. Swim goggles according to claim 1 wherein said second resilient sleeve sealingly engages the wearer's face.

4. Swim goggles according to claim 1 wherein at least one said resilient sleeve comprises an opaque portion covering a portion of said eyepiece wall.

5. Swim goggles according to claim 1 further comprising a third resilient sleeve disposed between said first and second resilient sleeves.

6. Swim goggles comprising:

(a) a pair of eyepieces each having a lens and an eyepiece wall for spacing said lens apart from a wearer's eye, said eyepiece wall having a front edge connected to said lens and a distal rear edge and having smooth outer surface free of protrusions;

(b) a nose strap connecting said eyepieces;

(c) a head strap connected to each eyepiece for extending around the head of a wearer;

(d) a first resilient material covering said eyepiece wall rear edge for reducing the pressure exerted on the wearer's face by said eyepiece wall rear edge;

(e) a second resilient material overlaying said first resilient material for sealingly engaging the wearer's face for excluding water from said eyepiece; and, at least one resilient material disposed between said first and second resilient materials.

7. Swim goggles according to claim 1 further comprising:

said nose strap having a first end portion, a second end portion, a longitudinal axis, and a first thickness, said nose strap first end portion including a pair of opposed transverse anchor flanges;

a first hollow lug extending outwardly from said first eyepiece lens away from the wearer's face and, said first hollow lug having an inner wall, an outer wall including an aperture therethrough, and internal strap engaging surfaces;

said nose strap first end portion received through said aperture and enclosed within said first hollow lug in a first position spaced apart from the wearer's nose; and said nose strap first end anchor flanges interlockingly engaged with said internal strap engaging surfaces.

8. Swim goggles according to claim 7 further comprising a second hollow lug extending outwardly from said second eyepiece lens away from the wearer's face, the second hollow lug including means for interlockingly engaging said nose strap second end portion at a plurality of predetermined positions.

9. Swim goggles according to claim 8 wherein said second hollow lug includes an outer wall having an aperture therethrough;

said nose strap second end portion received through said aperture and enclosed within said second hollow lug; and said nose strap second end portion including at least one raised transverse stop for interlockingly engaging said aperture, said transverse stop deformable so as to pass through said aperture responsive to a longitudinal force exerted on said strap.

10. Swim goggles comprising:

(a) first and second eyepieces, each said eyepiece having a lens and an eyepiece wall for spacing said lens apart from a wearer's eye, said eyepiece wall having a front edge connected to said lens and a distal rear edge;

(b) a head strap connected to each said eyepiece, said head strap for extending around the head of a wearer for securing said goggles thereon;

(c) an adjustable nose strap for connecting said first and second eyepieces comprising a resilient, flexible strap having first and second end portions, said first end portion including an anchor portion for attaching said first eyepiece to said nose strap in fixed relation thereto, said anchor portion having a pair of opposed anchor flanges extending outwardly from said nose strap first end portion;

(d) means attached to each eyepiece lens for securing said nose strap to each said eyepiece; and (e) said nose strap securing means comprising first and second lugs, said first lug extending outwardly from said first eyepiece lens and away from the wearer's face and having an aperture therethrough for receiving said nose strap first end portion, and having surfaces for engaging said anchor flanges for retaining said nose strap first end portion in said first lug, said second lug attached to said second eyepiece lens and extending substantially outwardly away from the wearer's face, and further including means for connecting said nose strap second end portion to said second lug at a plurality of positions for adjusting the length of said nose strap; and (f) said means for connecting said nose strap second end portion to said second lug including a longitudinal aperture in said second lug for receiving said nose strap second end portion, a transverse channel in said second lug communicating with said longitudinal aperture, a plurality of adjusting holes through said nose strap second end portion, each said adjusting hole for being aligned with said transverse channel for providing a predetermined nose strap length, and a locking pin for being inserted into said transverse channel and through one said adjusting hole for securing said nose strap second end portion in said second lug.

11. Swim goggles according to claim 10 wherein said locking pin includes a first portion having a diameter greater than the diameter of said adjusting hole for retaining said nose strap second end portion on said locking pin.

12. Swim goggles according to claim 7 wherein said resilient nose strap includes one or more transverse grooves, said grooves imparting to said nose strap a second thickness less than said first thickness.

13. Swim goggles comprising:

(a) First and second eyepieces (b) a head strap connected to each said eyepiece for extending around the head of a wearer;

(c) an adjustable nose strap having a longitudinal dimension and respective first and second end portions;

(d) first connecting means fixedly connecting said nose strap first end portion to said first eyepiece in a single predetermined longitudinal position, said first connecting means comprising opposed anchor flanges extending outwardly from said nose strap first end and said first eyepiece having surfaces adapted for fixedly engaging said anchor flanges and thereby connecting said nose strap in said single predetermined longitudinal position; and second connecting means for adjustably connecting said nose strap second end portion to said second eyepiece at a first longitudinal position, and adapted for connecting said nose strap second end portion to said second eyepiece at least one alternative longitudinal position.

14. Swim goggles according to claim 1 wherein said first resilient sleeve covering at least a portion of said eyepiece wall outer surface covers a portion of said eyepiece wall adjacent to said front edge.

15. Swim goggles comprising:

(a) First and second eyepieces, each said eyepiece having a lens and an eyepiece wall for spacing said lens apart from a wearer's eye, each eyepiece including surfaces defining respective first and second nose strap receiving apertures;

(b an adjustable nose strap connecting the eyepieces and having a longitudinal dimension and respective first and second end portions;

(c) said nose strap first end portion passable through said first and second nosestrap apertures and engageable with said first nose strap aperture at a plurality of selectable longitudinal positions;

(d) said nose strap second end portion having transverse flanges engaged with surfaces adjacent opposite ends of said second nose strap aperture, said transverse flanges including two opposed transverse flanges engaged with surfaces adjacent on said aperture end and which prevent passage of the nose strap second end portion through said second aperture.

* * * * *